US006263256B1

(12) United States Patent
Zheng

(10) Patent No.: US 6,263,256 B1
(45) Date of Patent: Jul. 17, 2001

(54) EMBROIDERY PATTERN DISPLAY APPARATUS

(75) Inventor: Xiao Ming Zheng, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/365,020

(22) Filed: Aug. 2, 1999

(30) Foreign Application Priority Data

Aug. 5, 1998 (JP) ..... 10-221593

(51) Int. Cl.[7] ..... G06F 19/00; D05C 5/06

(52) U.S. Cl. ..... 700/138; 112/102.5; 112/475.19

(58) Field of Search ..... 700/138, 136, 700/137; 112/102.5, 470.04, 470.06, 475.19, 445, 454, 456, 457, 458

(56) References Cited

U.S. PATENT DOCUMENTS 5,558,031 * 9/1996 Muto et al. ..... 112/470.04 X
5,954,004 * 9/1999 Futamura ..... 700/138 X
6,032,596 * 3/2000 Hayakawa ..... 112/102.5

* cited by examiner

*Primary Examiner*—Peter Nerbun
(74) *Attorney, Agent, or Firm*—Oliff & Berridge, PLC

(57) ABSTRACT

In an embroidery data display apparatus, four pattern names "A01", "A05", "A10" and "A17", for example, from which an embroidery pattern actually used for embroidering may be selected, are designated from a plurality of pattern names displayed on a CRT display, and pattern display data for the designated pattern names are generated in a time-sharing manner with background processing that is effected for minute time intervals α parallel with main processing. The pattern display data thus generated are successively displayed on a display upon completion of each set of data. When it is confirmed that the displayed pattern is the embroidery pattern to be actually used for embroidering, a stop key provided in a keyboard is operated to generate a stop command, which is accepted by the main processing even during generation of pattern display data, so that the pattern display data generating operations can be immediately terminated.

17 Claims, 8 Drawing Sheets

EMBROIDERY PATTERN DISPLAY APPARATUS

BACKGROUND OF THE INVENTION

1. Field of Invention

The invention relates to an embroidery pattern display apparatus, and in particular to such an apparatus that can accept various commands, such as a stop signal, from input means such as a keyboard, at any time even during execution of pattern display data generating operations for generating pattern display data based on embroidery data representing embroidery patterns to be formed by sewing.

2. Description of Related Art

Conventionally, embroidery data consisting of stitch position data representing sewing patterns to be formed by embroidering machines are generally produced by an embroidery data processing apparatus in the form of a computer equipped with a keyboard and a display. The embroidery data thus generated are recorded on a recording medium, such as a floppy disc, such that each set of embroidery data is associated with a corresponding pattern name. The floppy disc is then set in a floppy disc drive mounted in an embroidering machine as needed, and a desired embroidery pattern is formed with the embroidery machine, according to embroidery data of the desired pattern selectively read from the floppy disc. Alternatively, embroidery data is transmitted to an embroidering machine through a connection cable that connects the embroidery data processing apparatus with the embroidering machine, so that an embroidery pattern represented by the embroidery data is formed with the embroidering machine.

In the meantime, the pattern name associated with each set of embroidery data thus generated is often limited by the number of characters and/or the type of characters when it is recorded, and is thus not able to tell exactly what embroidery pattern is represented or expressed by the name. For example, where a plurality of sets of embroidery data related to embroidery patterns of "flower" are prepared, to represent various types of embroidery patterns that slightly differ in the size or number of petals, the appearance or size of branches, and other characteristics, the pattern names given to the respective sets of embroidery data cannot clearly express the characteristics, and are limited to rather simple names, such as "Flower No. 1" and "Flower No. 2".

Accordingly, when a desired embroidery pattern to be supplied for use in embroidering is selected from those stored in the floppy disc set in the embroidery machine, or a desired set of embroidery data to be supplied for use in embroidering is transmitted from the embroidery data processing apparatus to the embroidering machine through the connection cable, the desired embroidery pattern is confirmed on an embroidery pattern display device provided in the embroidery data processing apparatus or embroidering machine.

More specifically, the embroidery pattern display device is requested to display all of a plurality of pattern names stored in the floppy disc, and then display a few embroidery patterns of designated pattern names from which an embroidery pattern to be actually used for embroidering is to be selected. Based on the embroidery data of the designated pattern names, pattern display data are generated wherein dot data "1" represent a multiplicity of needle-drop positions corresponding to multiple pieces of needle-drop data contained in the embroidery data.

Upon completion of generation of a certain set of pattern display data, the corresponding pattern is displayed along with its pattern name in a certain display region of the display. Thus, the plural patterns are successively displayed in respective display regions in the order of completion of the pattern display data. After confirming the displayed patterns, the operator designates or selects a desired pattern name, so as to cause the embroidering machine to form a pattern corresponding to the selected pattern name. In this case, however, the operations to generate pattern display data are dominantly performed as main processing, and therefore any key operation on the keyboard is nullified or made invalid until the pattern display data generating operations for the designated pattern names are completed and the resulting patterns are displayed.

As described above, any key operation on the keyboard is nullified or made invalid until pattern display data of the plurality of pattern names selected from the pattern names listed on the display are completely generated, and all patterns of the generated pattern display data are displayed on the display screen. With this arrangement, even in the case where a desired embroidery pattern is displayed in an early stage during the generation of the pattern display data, the pattern display data generating operations cannot be interrupted midway, and the operator must patiently wait for the last pattern to be generated and displayed. Thus, the known apparatus has a problem of an undesirably low operating efficiency in the pattern recognition/confirmation procedure.

SUMMARY OF THE INVENTION

It is therefore an object of the invention to provide an embroidery pattern display apparatus wherein a pattern display data generating operation that permits pattern recognition/confirmation can be immediately terminated at a desired point in time during the operation, thus assuring improved efficiency in the pattern recognition/confirmation procedure, and wherein a plurality of sets of pattern display data can be sequentially generated in a time-sharing manner.

To accomplish the above object, the invention provides an embroidery pattern display apparatus, comprising embroidery data storage means for storing embroidery data representing a plurality of embroidery patterns to be formed by sewing; input means for designating at least one of the embroidery patterns; a display that displays the embroidery patterns of the embroidery data read from the embroidery data storage means; display data generating means for generating pattern display data based on the embroidery data of at least one of the embroidery patterns designated by the input means; concurrent processing control means for executing a display data generating operation of the display data generating means with background processing, in parallel with main processing; and pattern display control means for causing the display to display the pattern display data generated by the display data generating means.

When some embroidery patterns from which an embroidery pattern actually used for embroidering may be selected are designated through the input device, such as a keyboard, the concurrent processing control means controls the display data generating means to generate pattern display data with background processing, rather than main processing. Thus, the display data generating means generates pattern display data with the background processing, based on embroidery data of the designated embroidery patterns. The pattern display control means then causes the display to display pattern display data generated by the display data generating means. When the operator confirms that the pattern appearing on the display is the embroidery pattern to be actually used for embroidering, he/she can enter a stop command through the input means, to be accepted with the main processing, even in the middle of generating the remaining pattern display data with the background processing, so as to immediately terminate the pattern display data generating operations. Thus, the apparatus of the invention does not require the operator to patiently wait for all of pattern display data to be generated and displayed, thus assuring an improved efficiency in the pattern recognition/confirmation procedure.

In one preferred form of the invention, the concurrent processing control means switches the main processing to the background processing and vice versa in a time-sharing manner, so as to alternately execute the main processing and the background processing.

In this case, the main processing and the background processing can be alternately executed or switched from one to the other in a time-sharing manner, thus enabling the apparatus to surely accept a stop command from the input means during execution of the main processing.

In a further preferred form of the invention, when the display data generating means performs a plurality of operations to generate a plurality of sets of pattern display data with the background processing, the concurrent processing control means controls the display data generating means to execute the pattern display data generating operations in a predetermined order while switching from one of the operations to another in a time-sharing manner at predetermined time intervals.

With the above arrangement, when the display data generating means performs the plural pattern data generating operations with the background processing, the concurrent processing control means is able to control the display data generating means to perform the display data generating operations in turn while switching from one operation to another in a time-sharing manner with a predetermined time-sharing period.

In still another preferred form of the invention, the pattern display control means receives the plurality of sets of pattern display data from the display data generating means, and distinctly displays a plurality of patterns corresponding to the respective sets of pattern display data, in a plurality of display regions on the display.

In this case, the pattern display control means receives the plural sets of pattern display data from the display data generating means, and distinctly or separately displays the plural patterns in respective display regions, so that the operator can distinguish and accurately confirm the patterns of the generated pattern display data without making a mistake on the display.

According to another aspect of the invention, there is provided a computer-readable storage medium that stores a program for causing a display to display at least one embroidery pattern represented by embroidery data read from embroidery data storage means for storing embroidery data of a plurality of embroidery patterns to be formed by sewing, comprising display data generating means for generating pattern display data based on embroidery data of at least one embroidery pattern designated by input means; concurrent processing control means for executing a display data generating operation of the display data generating means with background processing, in parallel with main processing; and pattern display control means for causing the display to display the pattern display data generated by the display data generating means.

BRIEF DESCRIPTION OF THE DRAWINGS

The invention will be described in greater detail with reference to preferred embodiments thereof and the accompanying drawings, wherein.

DETAILED DESCRIPTION OF PREFERRED EMBODIMENTS

A preferred embodiment of the invention will be described in detail with reference to the drawings. In the embodiment, the invention is applied to an embroidery data processing apparatus in the form of a personal computer which is capable of displaying patterns.

Figure 1:
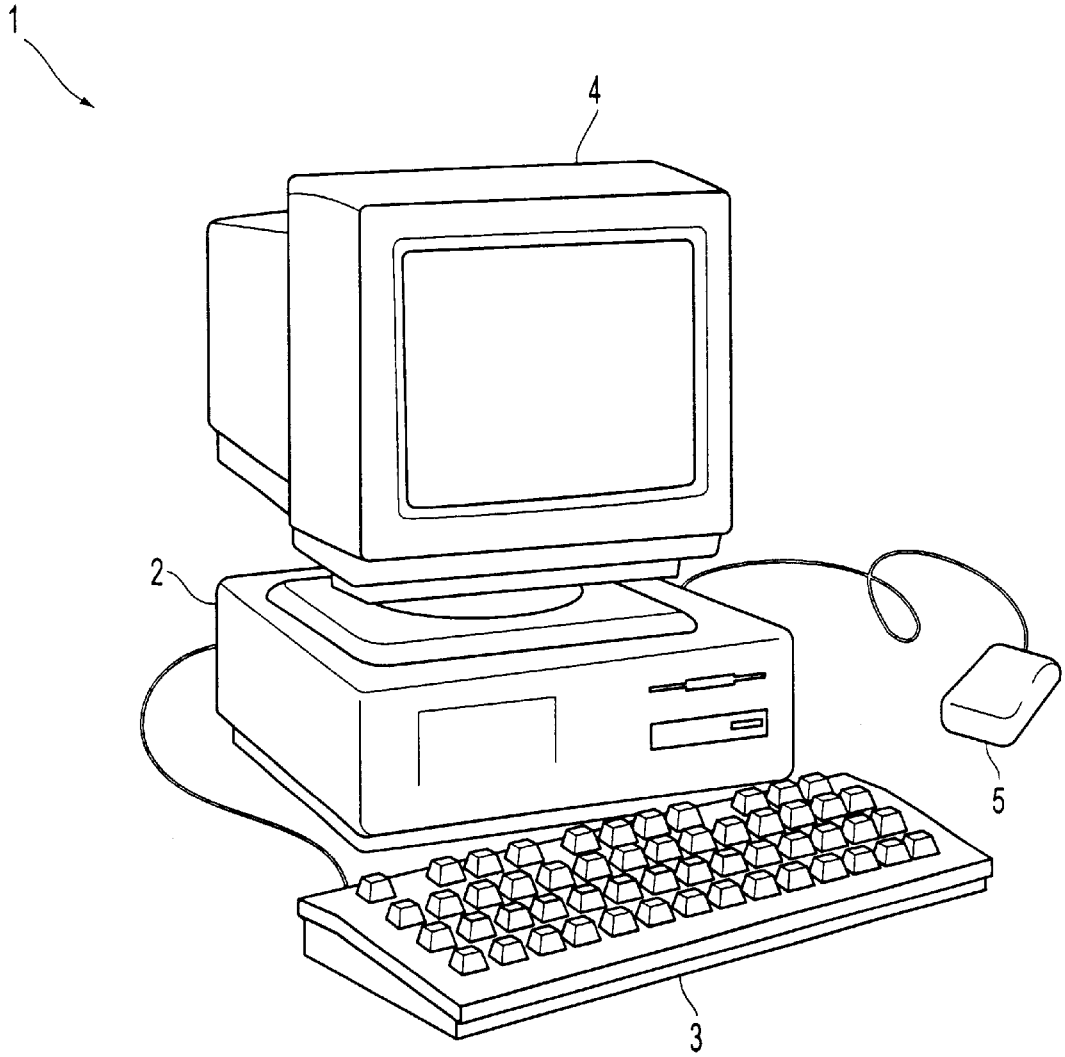
FIG. 1 is a perspective view showing an embroidery data processing apparatus according to one embodiment of the invention.
Figure 2:
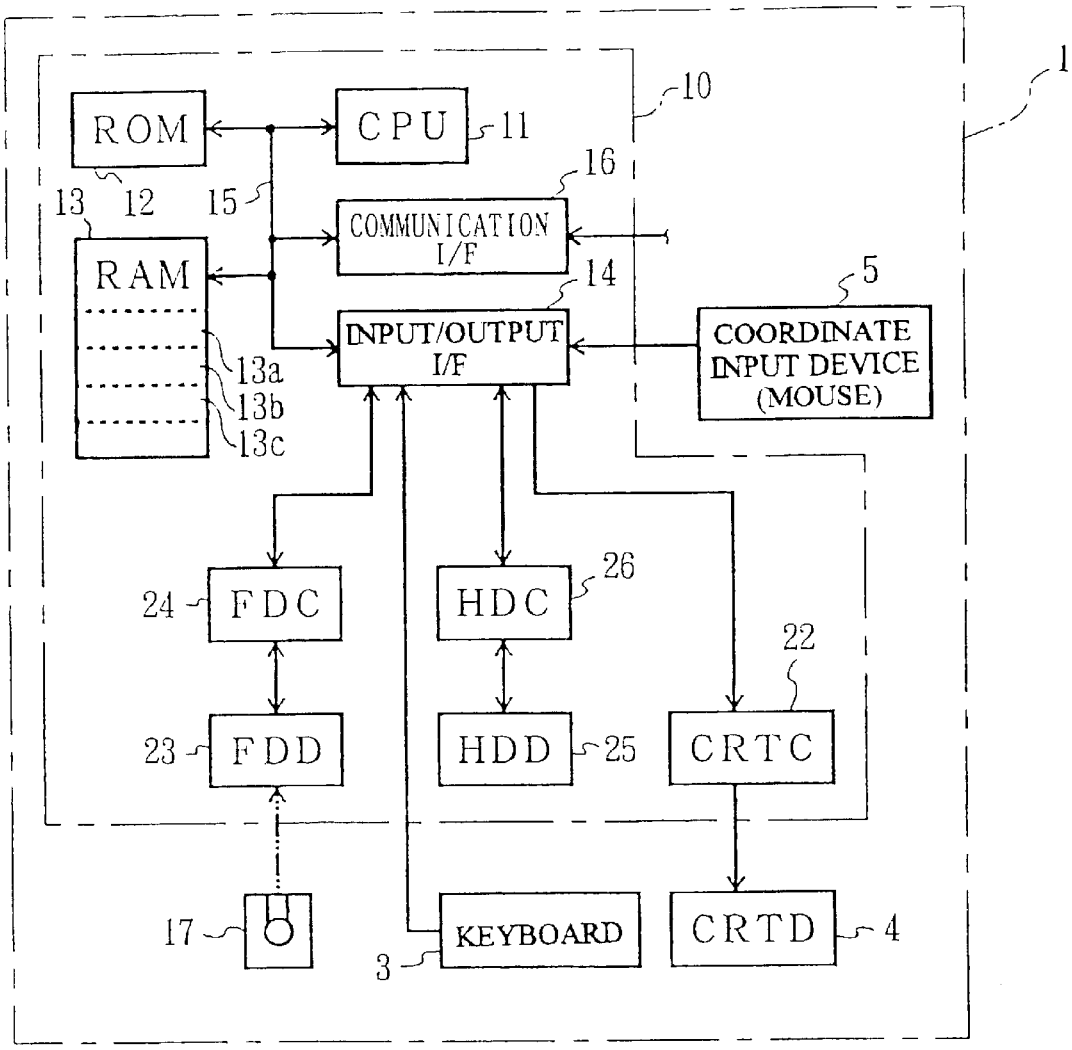
FIG. 2 is a block diagram of a control system of the embroidery data processing apparatus.

As shown in FIG. 1, the embroidery data processing apparatus 1 principally comprises a control box 2 that incorporates a floppy disc drive 23, a hard disc drive 25, as shown in FIG. 2, and other read/write devices as appropriate, such as ZIP or CD drives, a keyboard 3, a CRT color display 4, a coordinate input device (e.g., mouse), and any other desired peripheral, such as a scanner or printer.

A control system for the embroidery data processing apparatus 1 is shown in FIG. 2. A host controller 10, provided in the control box 2, includes a CPU 11, ROM 12 and RAM 13 that are connected to the CPU 11 via a common bus 15, such as a data bus, an input/output interface 14, a communication interface (communication I/F) 16, a CRT controller (CRTC) 22 for outputting display data to the CRT display (CRTD) 4, a floppy disc controller (FDC) 24 for driving and controlling the floppy disc drive (FDD) 23, and a hard disc controller (HDC) 26 for driving and controlling the hard disc drive (HDD) 25. The CRTC 22, FDC 24, and HDC 26 are connected to the input/output interface 14.

Here, the communication I/F 16 comprises, for example, a Centronics interface and enables two-way data communication between the present apparatus and various types of electronic equipment, such as an external computer or a printer. To the input/output I/F 14 are connected the keyboard 3 used for entering characters, symbols, and the like, and the coordinate input device (or mouse) 5. As in a general personal computer, the ROM 12 stores an activation program (bootstrap loader) that activates or starts the embroidery data processing apparatus 1 when the power supply is turned on.

A hard disc mounted in the HDD 25 stores communication protocols for transmitting and receiving data to and from external terminals, and various application programs, such as word processing software and embroidery data generation/editing software, that can be executed on the system, as well as various OS (operating systems), such as MS-DOS and Windows. The hard disc also stores control programs to be executed to perform various types of controls, such as the control of the pattern display data generating operations, control of the embroidery data editing operations, display control, and control of the concurrent processing including main processing and background processing as described later.

To perform the embroidery data editing operations, the hard disc in the HDD 25 stores edit programs for enabling a plurality of types of editing actions or tasks, including "MOVE" for moving an object to be edited in vertical and lateral directions, "ENLARGE" for enlarging the object at a selected enlargement ratio, "REDUCE" for reducing the size of the object at a selected reduction ratio, "MIRROR" for inverting the object upside down or laterally, and "ROTATE" for rotating the object by a selected rotating angle in a selected direction.

A floppy disk 17 (corresponding to embroidery data storage means) that is removably mounted in the FDD 23 stores embroidery data (needle-drop data) indicative of a plurality of embroidery patterns to be formed by a sewing machine, which data were produced in advance using the keyboard 3 or mouse 5, such that the embroidery data are classified into some pattern categories.

The RAM 13 includes a display pattern name memory 13*a* that stores the names of patterns to be supplied to pattern display data generating operations, which patterns are selected from a plurality of sets of embroidery data generated in advance and stored in the floppy disc 17. The RAM 13 also has a task number memory 13*b* that stores the number of tasks or operations to be performed to generate the required sets of pattern display data, and a display data memory 13*c* that stores generated pattern display data in association with the corresponding pattern names. The RAM 13 further includes other memories needed for implementing various controls, including a data memory or work memory for temporarily storing various types of data, and a memory or memories for storing various flags, pointers, counters, and so forth.

Figure 4:
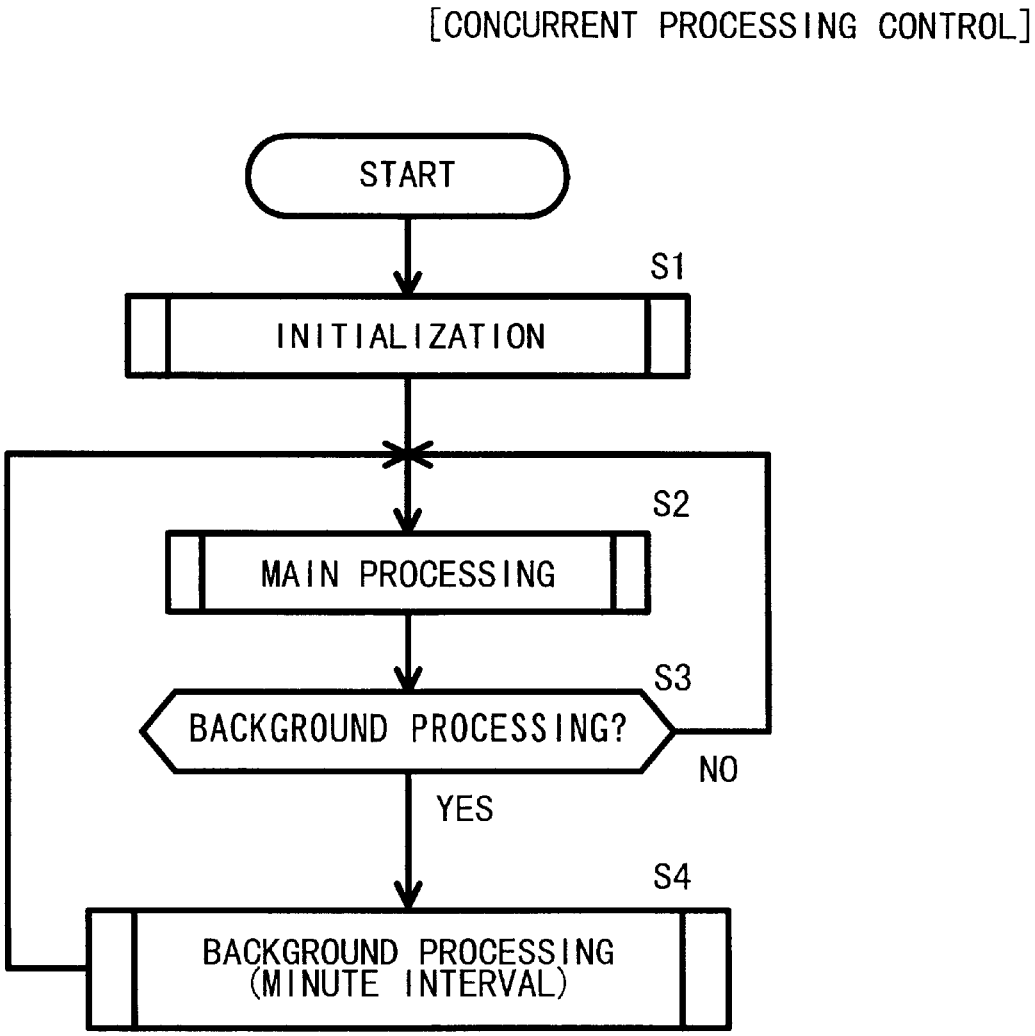
FIG. 4 is a flowchart showing a routine for concurrent processing control.
Figure 5:
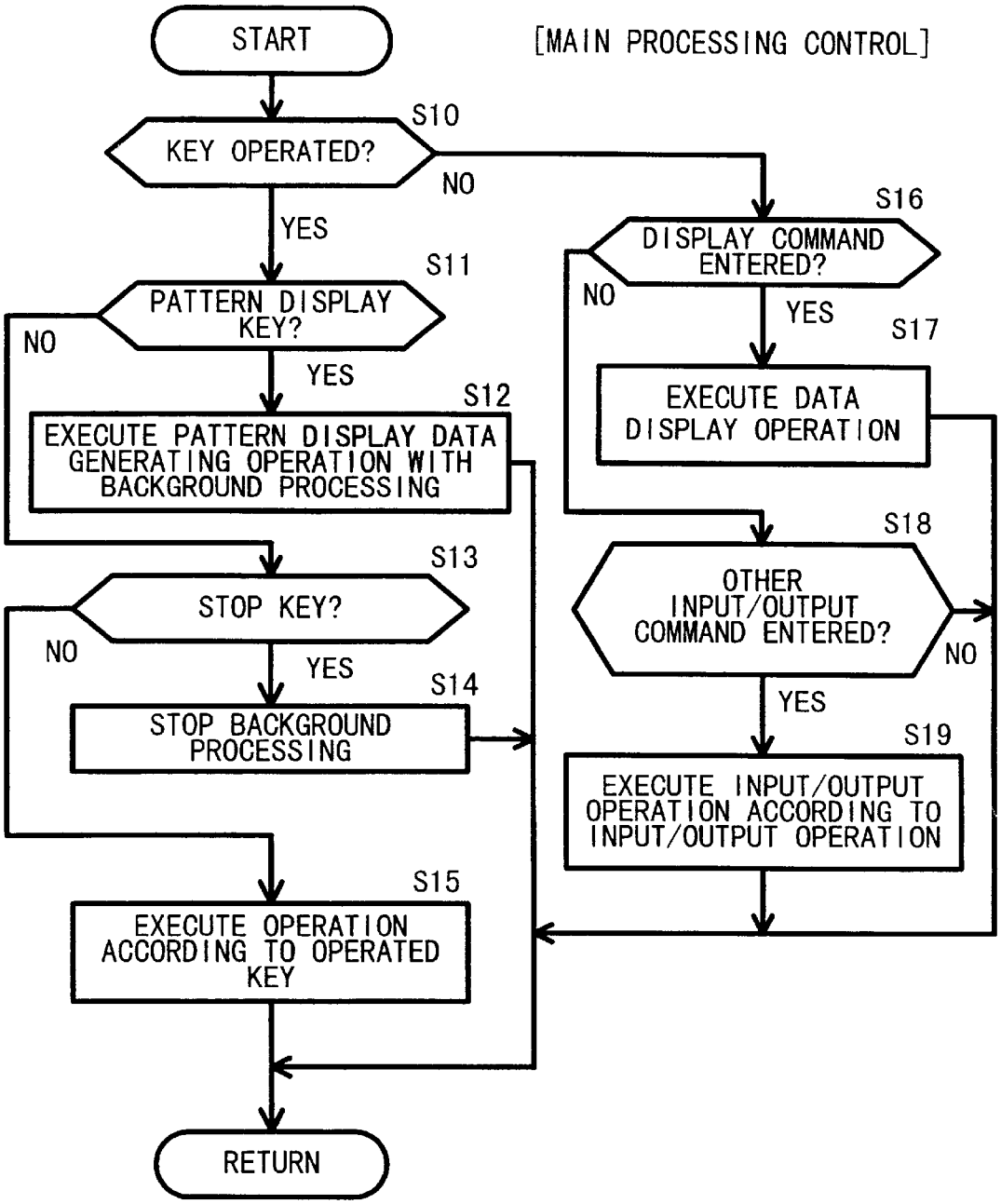
FIG. 5 is a flowchart showing a routine for main processing control.
Figure 6:
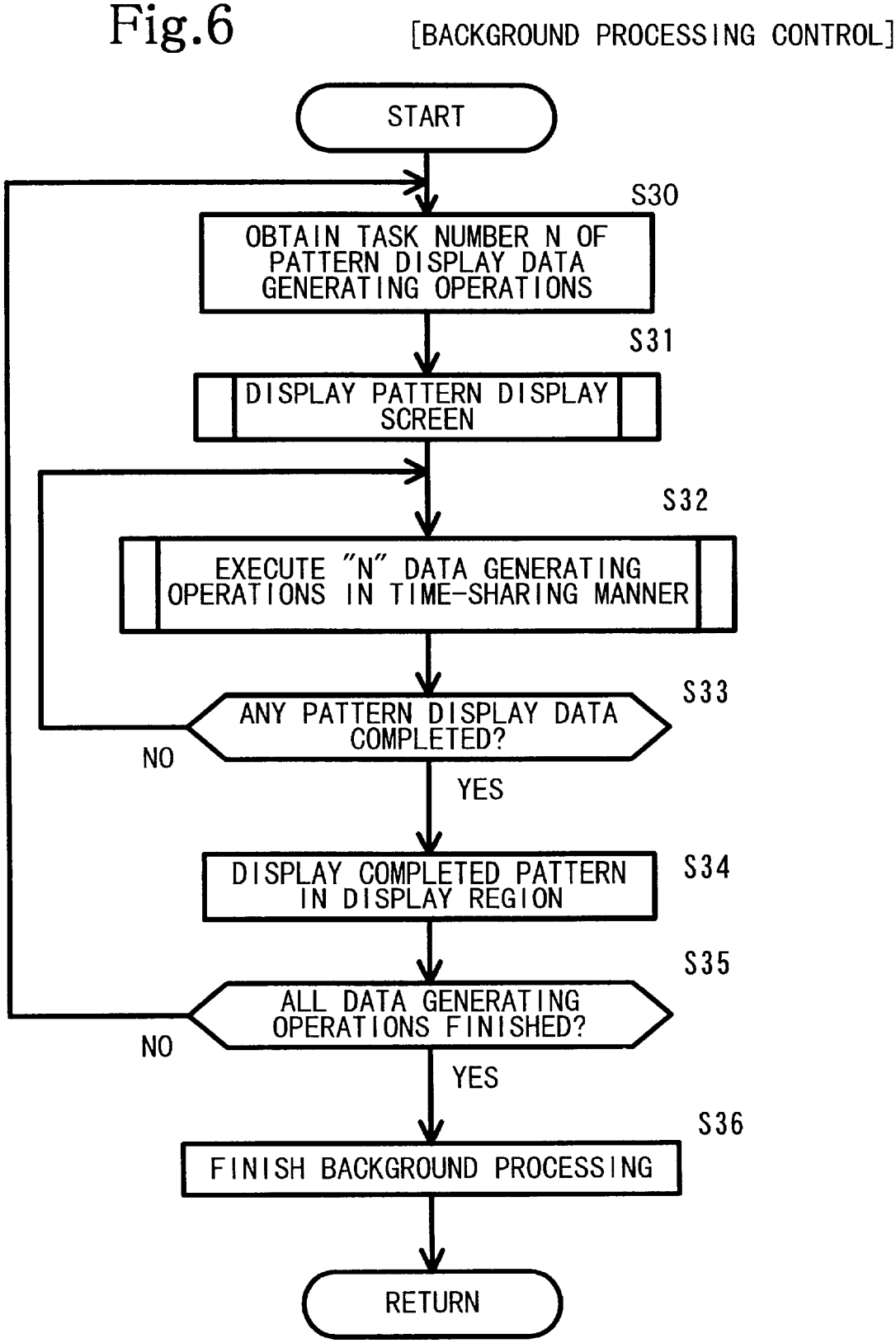
FIG. 6 is a flowchart showing a routine for background processing control.

As described above, the hard disc in the HDD 25 stores a program for controlling concurrent processing including main processing and background processing, which is peculiar to the invention. Referring to the flowcharts of FIGS. 4 to 6, the routine of concurrent processing control will be described in detail. In FIGS. 4–6, "Si" (i=1, 2, 3, . . . ) represents each step of the control routine.

The concurrent processing control will be briefly described with reference to FIG. 3A. Control operations with input and output command signals received from or generated to peripheral equipment, such as the keyboard 3, CRT display 4, FDD 23, or the like, are performed with the main processing, and input/output control over the peripheral equipment according to the input/output command signals is implemented with input/output processing, while operations for generating pattern display data from embroidery data of designated pattern names are performed with the background processing.

Figure 3A:
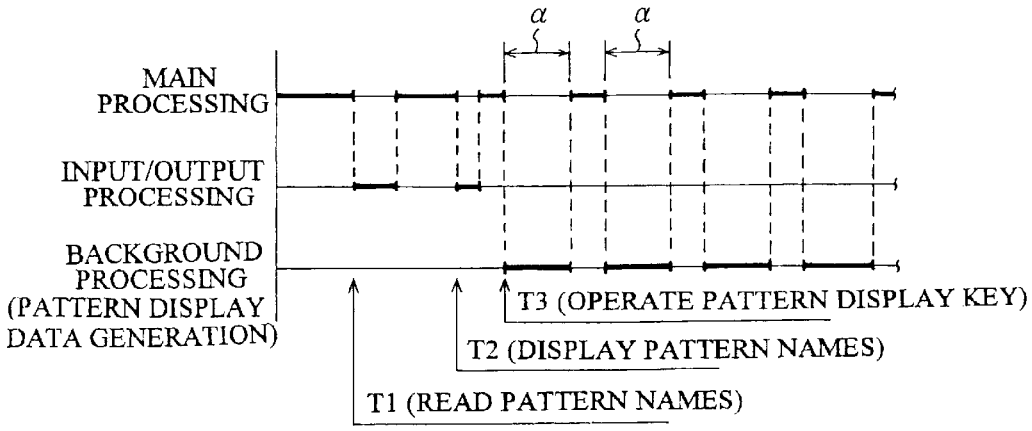
FIG. 3A is a time chart showing main processing and background processing that are executed in a time-sharing manner.

As shown in FIG. 3A, when a pattern name read-out key on the keyboard 3 is operated at a point of time T1 during execution of the main processing, an input/output operation for reading all of the pattern names recorded on the floppy disk 17 mounted in the FDD 23 is executed, and an input/output operation for displaying all of the read pattern names is executed at a point of time T2. Then, four pattern names "A01", "A05", "A10" and "A17" representing embroidery patterns that may be supplied for use in embroidering are selected from the plurality of pattern names at a point of time T3. When a pattern display key is operated at the point of time T3 to instruct generation of pattern display data corresponding to the above patterns, pattern display data generating operations are performed with the background processing, as opposed to the main processing.

Upon and after the point of time T3, the main processing and the background processing are switched from one to the other and vice versa in a time-sharing manner, and thus alternately executed. In this operation, the background processing is interrupted after intervals of a certain period of time $\alpha$ (for example, 10 msec) and switched to the main processing.

Once the background processing is started at the point of time T3, four sets of pattern display data corresponding to the above-indicated four pattern names "A01", "A05", "A10" and "A17" are generated in a time-sharing manner, such that an operation to generate one set of pattern display data is interrupted and followed by the next operation to generate another set of pattern display data at certain time intervals $\beta$. Namely, switching of pattern display data generating operations occurs with the time-sharing period $\beta$.

If the operation to generate pattern display data of the pattern name "A05" is first completed at a point of time T5, the corresponding pattern is displayed in a certain display region of the CRT display 4. If the pattern thus displayed is the embroidery pattern to be supplied for use in embroidering, there is no need to continue generating pattern display data of the other pattern names "A01", "A10" and "A17". If a stop key or escape key provided on the keyboard 3 is operated at this time, therefore, the key operation is accepted during execution of the main processing, and the background processing for generating pattern display data can be instantly stopped or terminated.

When the embroidery data processing apparatus 1 is turned on, the above described concurrent processing control is started. Initially, step S1 is executed to perform initialization, such as clearing of each memory of the RAM 13, and step S2 is executed to perform main processing as shown in FIG. 5.

If no key is operated on the keyboard 3 upon start of the main processing (S10: No), but a display command is then entered (S16: Yes), step S17 is executed to generate a command to perform a data displaying operation. If another input/output command, such as an input/output command with respect to the FDD 23, is entered (S18: Yes), step S19 is executed to generate a command to perform an input/output operation according to the input/output command, and the current control cycle is finished. The control flow then returns to the initial step.

If any one of the keys on the keyboard 3 is operated (S10 :Yes), and the operated key is not a pattern display key nor a stop key (S11: No, S13: No), step S15 is executed to generate a command to perform an operation corresponding to the operated key, and the current control cycle is finished in the same manner as described above. For example, if a pattern name read-in key is operated, all of the pattern names recorded on the floppy disc 17 are retrieved. If a command to display the pattern names is generated (S10: No, S16: Yes) in the next cycle, a data displaying operation is performed in step S17 for displaying all of the pattern names thus retrieved.

If the operator designates or selects certain names of embroidery patterns that may be supplied for use in embroidering, from the pattern names on the display, and operates a pattern display key to generate pattern display data (S11: Yes), the designated pattern names are stored to the display pattern name memory 13*a*, and corresponding pattern display data are generated in the background processing in step S12.

As a result, an affirmative decision (Yes) is obtained in step S3 of the concurrent processing control routine of FIG. 4, and background processing as shown in FIG. 6 is executed during certain minute time intervals α in step S4.

Figure 7:
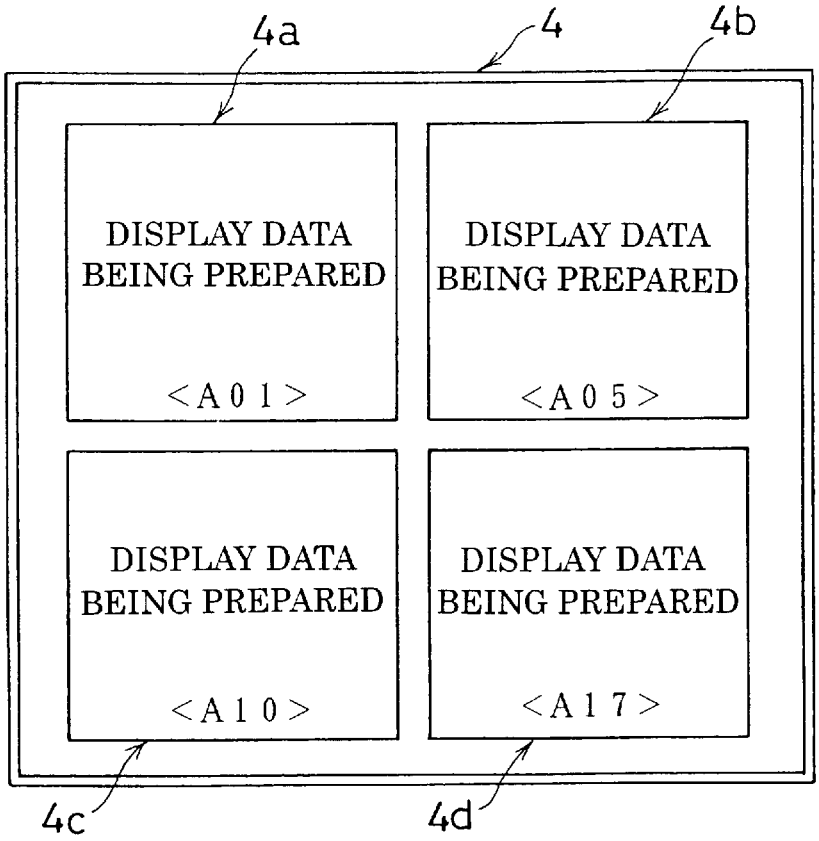
FIG. 7 is a view showing an example of a display on a pattern display screen having a plurality of display regions.
Figure 8:
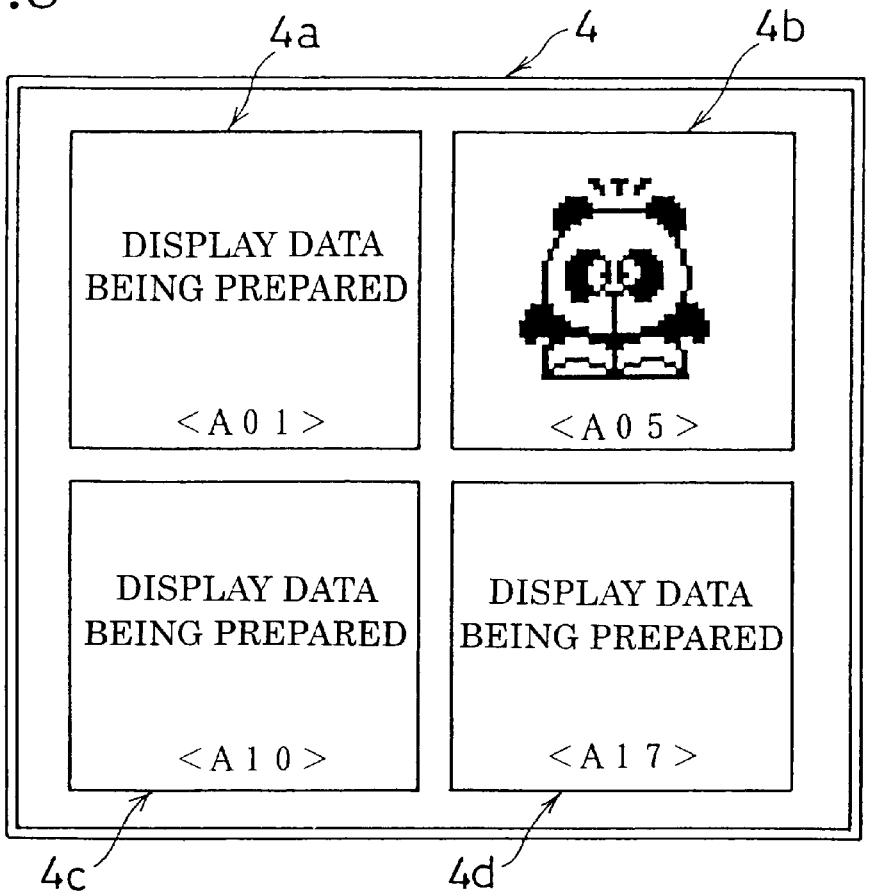
FIG. 8 is a view corresponding to that of FIG. 7, in which a pattern of generated pattern display data is displayed.

Upon start of the background processing, step S30 is initially executed to obtain the number of tasks or operations N to be performed for generating pattern display data, based on the number of the pattern names stored in the display pattern name memory 13*a*, and pattern display windows that define pattern display regions corresponding to the number of tasks N are displayed on the CRT display 4 in step S31. For example, where the above-indicated four pattern names "A01", "A05", "A10" and "A17" are selected (in this case, the task number N is 4), four pattern display windows having respective display regions 4*a*–4*d* are displayed on the CRT display 4, as shown in FIG. 7. At this time, a message "DISPLAY DATA BEING PREPARED" is displayed in each of the display regions 4*a*–4*d*.

Figure 3B:
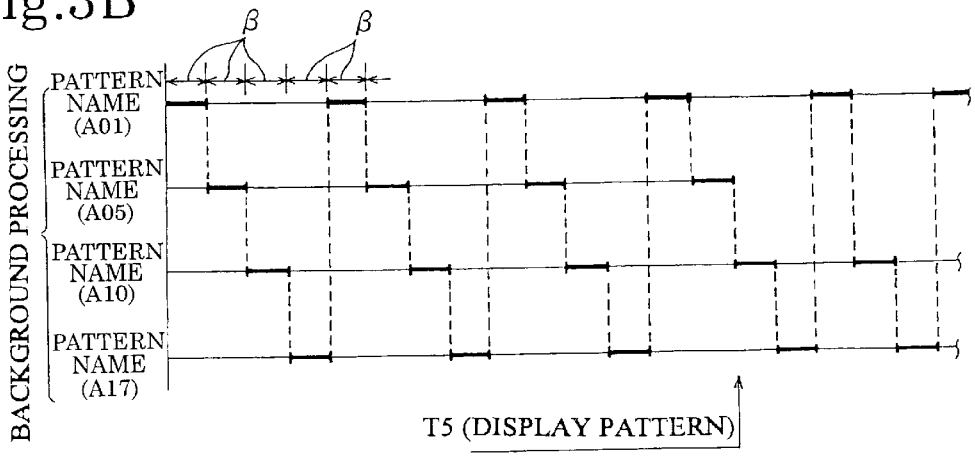
FIG. 3B is a time chart showing operations to generate a plurality of sets of pattern display data in a time-sharing manner.

In the next step S32, the N data generating operations are sequentially performed in a predetermined order in a time-sharing manner, according to the control routine for pattern display data generation. More specifically, the operations to generate respective sets of pattern display data for the above four pattern names "A01", "A05", "A10" and "A17" are carried out in a time-sharing manner, such that one operation to generate one set of pattern display data is interrupted and followed by the next operation to generate another set of pattern display data at certain time intervals β (time-sharing period=β), as shown in FIG. 3B. If no set of pattern display data has been completed (S33: No), steps S32 and S33 are repeatedly executed. If any of the plural sets of pattern display data is completed (S33: Yes), step S34 is executed to generate a command to display the completed pattern in the relevant display region of the CRT display 4.

For example, if pattern display data of the second-designated pattern name "A05" having a small data amount is first completed, the corresponding pattern "panda" is displayed along with the pattern name "A05" in the relevant display region 4*b* of the pattern display screen. If all of the data generating operations have not been finished (S35: No), steps S30–S35 are repeatedly executed. Then, if all of the data generating operations with respect to all of the designated pattern names have been finished (S35: Yes), the background processing is terminated in step S36, the control routine is finished, and returns to step S2 of the concurrent processing control.

If the completed pattern displayed in any one of the display regions 4*a*–4*d* according to a display command in step S34 of the background processing control is the embroidery pattern to be supplied for use in embroidering, it is unnecessary to continue generating pattern display data of the remaining pattern names, and therefore the stop key or escape key provided on the keyboard 3 is operated. The operation of the stop key is then accepted during execution of the main processing (S10: Yes, S11: No, S13: Yes), and step S14 is executed to generate a stop command to immediately stop the background processing. Consequently, a negative decision (No) is obtained in step S3 of the concurrent processing control, and the background processing is immediately stopped.

In the present embodiment, the keyboard 3, mouse 5, and others provide input means, the CRTD 4, CRTC 22, and others provide display means, and the control program stored in the hard disc for generating pattern display data corresponds to display data generating means for generating pattern display data from embroidery data of embroidery patterns. Also, the control program for concurrent processing of FIG. 4 and others provide concurrent processing control means. Steps S16–S17, in particular, of the control routine for main processing, step S34, in particular, of the control routine for background processing, display control program, and others provide pattern display control means.

As described above, pattern display data of a plurality of embroidery patterns designated with the keyboard 3, from which an embroidery pattern actually used for embroidering is to be selected, are generated with the background processing, in parallel with the main processing, and pattern display data thus generated are successively displayed upon completion thereof. When the operator confirms that the pattern appearing on the display is the embroidery pattern to be supplied for use in embroidering, the stop key provided in the keyboard 3 is operated, and the key operation is surely accepted or recognized with the main processing, even during generation of other pattern display data. In response to the stop command, the operations to generate pattern display data can be immediately or instantly stopped, without requiring the operator to patiently wait for completion of generation of all pattern display data. Thus, the operator can accomplish the pattern recognition/confirmation procedure with high efficiency.

When a plurality of sets of pattern display data are generated with the background processing, the respective operations of generating pattern display data are performed in turn in a time-sharing manner, such that one operation to generate one set of pattern display data is interrupted and followed by another operation to generate the next set of pattern display data at certain time intervals β, and thus switching of the pattern display data generating operations occurs with the time-sharing period β. Also, because a plurality of patterns represented by the plural sets of pattern display data are distinguishably displayed in the respective display regions 4*a*–4*d* of the CRT display 4, the operator is able to distinguish the patterns of the thus generated pattern display data on the CRT display 4, and select or confirm a desired one of the patterns with high accuracy.

When a plurality of pattern display data generating operations are performed with the background processing, the pattern names representing possible (candidate) embroidery patterns for use in embroidering may be given varying degrees of priority, and the period for generating pattern display data of the pattern having the higher priority may be set to longer than that of the pattern having the lower priority. Also, a plurality of CPUs may be provided for performing a plurality of operations for generating pattern display data in a multitask processing mode. While the apparatus of the illustrated embodiment is constructed such that various control programs for executing respective operations of the invention are stored in the hard disc in the illustrated embodiment, these programs may be stored in advance in the ROM. Also, the control programs may be stored in a storage medium, such as a CD-ROM or a floppy disc, and read out and stored to the RAM or hard disc as needed. In addition, the invention is not limited to details of the illustrated embodiment, but may be otherwise embodied with various changes or modifications in control of each portion of the apparatus, without departing from the principle of the invention. Furthermore, the invention may be equally applied to various other types of embroidery data processing apparatus for generating or editing various types of embroidery data.

What is claimed is:

1. An embroidery pattern display apparatus, comprising:

embroidery data storage means for storing embroidery data representing a plurality of embroidery patterns to be formed by sewing;

input means for designating at least one of the embroidery patterns;

a display that displays the embroidery patterns of the embroidery data read from said embroidery data storage means;

display data generating means for generating pattern display data based on the embroidery data of said at least one of the embroidery patterns designated by said input means;

concurrent processing control means for executing a display data generating operation of said display data generating means with background processing, in parallel with main processing; and pattern display control means for causing said display to display the pattern display data generated by said display data generating means.

2. The embroidery pattern display apparatus according to claim 1, wherein said concurrent processing control means switches the main processing to the background processing and vice versa in a time-sharing manner, so as to alternately execute the main processing and the background processing.

3. The embroidery pattern display apparatus according to claim 1, wherein, when said display data generating means performs a plurality of operations to generate a plurality of sets of pattern display data with the background processing, said concurrent processing control means controls the display data generating means to execute the pattern display data generating operations in a predetermined order while switching from one of the operations to another in a time-sharing manner at predetermined time intervals.

4. The embroidery pattern display apparatus according to claim 2, wherein, when said display data generating means performs a plurality of operations to generate a plurality of sets of pattern display data with the background processing, said parallel processing control means controls the display data generating means to execute the pattern data generating operations in a predetermined order while switching from one of the operations to another in a time-sharing manner at predetermined time intervals.

5. The embroidery pattern display apparatus according to claim 3, wherein said pattern display control means receives said plurality of sets of pattern display data from said display data generating means, and distinctly displays a plurality of patterns corresponding to the respective sets of pattern display data, in a plurality of display regions on the display.

6. The embroidery pattern display apparatus according to claim 4, wherein said pattern display control means receives said plurality of sets of pattern display data from said display data generating means, and distinctly displays a plurality of patterns corresponding to the respective sets of pattern display data, in a plurality of display regions on the display.

7. A computer-readable storage medium that stores a program for causing a display to display at least one embroidery pattern represented by embroidery data read from embroidery data storage means for storing embroidery data of a plurality of embroidery patterns to be formed by sewing, comprising:

a display data generating routine for generating pattern display data based on embroidery data of at least one embroidery pattern designated by input means;

a concurrent processing control routine for executing a display data generating operation of said display data generating routine with background processing, in parallel with main processing; and a pattern display control routine for causing said display to display the pattern display data generated by said display data generating routine.

8. The computer-readable storage medium according to claim 7, wherein said concurrent processing control routine switches the main processing to the background processing and vice versa in a time-sharing manner, so as to alternately execute the main processing and the background processing.

9. The computer-readable storage medium according to claim 7, wherein, when said display data generating routine performs a plurality of operations to generate a plurality of sets of pattern display data with the background processing, said concurrent processing control routine controls the display data generating routine to execute the pattern display data generating operations in a predetermined order while switching from one of the operations to another in a time-sharing manner at predetermined time intervals.

10. The computer-readable storage medium according to claim 8, wherein, when said display data generating routine performs a plurality of operations to generate a plurality of sets of pattern display data with the background processing, said parallel processing control routine controls the display data generating routine to execute the pattern data generating operations in a predetermined order while switching from one of the operations to another in a time-sharing manner at predetermined time intervals.

11. The computer-readable storage medium according to claim 9, wherein said pattern display control routine receives said plurality of sets of pattern display data from said display data generating routine, and distinctly displays a plurality of patterns corresponding to the respective sets of pattern display data, in a plurality of display regions on the display.

12. The computer-readable storage medium according to claim 10, wherein said pattern display control routine receives said plurality of sets of pattern display data from said display data generating routine, and distinctly displays a plurality of patterns corresponding to the respective sets of pattern display data, in a plurality of display regions on the display.

13. A method for improved efficiency in selecting an embroidery pattern for sewing using an electronic processing apparatus, comprising the steps of:

initiating an embroidery pattern selection process by displaying a list of embroidery patterns available;

selecting candidate embroidery patterns for sewing from the list of embroidery patterns;

creating a specified display area on a display for each selected candidate embroidery pattern;

commencing data processing to generate a display of the selected candidate embroidery patterns in the respective specified display areas, the processing to generate a display of the selected candidate embroidery patterns being done in a time-shared manner; and switching processing of the electronic processing apparatus between main processing and data processing on a time share basis.

14. The method according to claim 13, wherein the data processing to generate a display occurs for a period $\alpha$ which is divided into a number of periods equal to a number of selected embroidery patterns for generating display data for the each selected candidate embroidery pattern, the periods alternating with periods $\gamma$ of main processing.

15. The method according to claim 14, further including a step of displaying a selected candidate embroidery pattern in the specified display area upon completion of data processing for the candidate embroidery pattern.

16. The method according to claim 15, further comprising an execution step wherein a final selection is made when a desired embroidery pattern is displayed on the display, the execution step terminating any further data processing for selected candidate embroidery patterns not yet displayed.

17. The method according to claim 16, wherein the execution step is executed during a $\gamma$ period.

* * * * *